US006747868B2

(12) United States Patent
Shin

(10) Patent No.: US 6,747,868 B2
(45) Date of Patent: Jun. 8, 2004

(54) IC CARD CONNECTOR

(75) Inventor: Chen Shih Shin, Taipei (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/355,853

(22) Filed: Jan. 31, 2003

(65) Prior Publication Data

US 2003/0150914 A1 Aug. 14, 2003

(30) Foreign Application Priority Data

Feb. 8, 2002 (TW) ..... 91201762 U

(51) Int. Cl.[7] ..... H01R 13/62
(52) U.S. Cl. ..... 361/684; 439/159
(58) Field of Search ..... 361/684, 685, 361/754, 756, 759, 798; 439/152, 153, 159, 160

(56) References Cited

U.S. PATENT DOCUMENTS 5,997,325 A * 12/1999 Hara ..... 439/159
6,030,238 A * 2/2000 Dong ..... 439/159
6,042,402 A * 3/2000 Tung et al. ..... 439/159
6,071,134 A * 6/2000 Tung ..... 439/159
6,139,340 A * 10/2000 Niitsu ..... 439/159
6,609,918 B2 * 8/2003 Uchikawa ..... 439/159

* cited by examiner

*Primary Examiner*—Chau N. Nguyen
*Assistant Examiner*—Carmelo Oliva
(74) *Attorney, Agent, or Firm*—Stacey E. Caldwell

(57) ABSTRACT

An IC card connector is provided for connecting an IC card having a terminal array and ejecting the card from the connector. A support structure has a receptacle for receiving the IC card for movement to a connecting position. An elongated push rod is linearly movably mounted on the support structure and is effective for ejecting the IC card from its connecting position, the push rod having an outer end. A push button is pivotally mounted to the outer end of the elongated push rod for movement between an inoperative position protruding colinearly from the outer end of the push rod and an inoperative position protruding angularly from one side of the push rod. An elastic member is coupled between the push rod and the push button for biasing the push button toward its operative position. A latch is operatively associated between the push rod and the push button for holding the push button in its inoperative position.

19 Claims, 4 Drawing Sheets

IC CARD CONNECTOR

FIELD OF THE INVENTION

This invention generally relates to the art of electrical connectors and, particularly, to an IC card connector assembly for connecting an IC card, such as a memory card, in some form of IC card reader system.

BACKGROUND OF THE INVENTION

IC (integrated circuit) cards are known in the art and contain intelligence in the form of a memory circuit or other electronic program. Some form of card reader reads the information or memory stored on the card. IC cards are used in countless applications in today's electronic society, including video cameras, smartphones, music players, ATMs, cable television decoders, toys, games, pc adapters and other electronic applications.

Typically, an IC card includes a terminal array for connection through an electrical connector to a card reader system and then to external equipment. The connector readily accommodates insertion and removal of the card to provide quick access to the information and program on the card. The card connector includes contacts for yieldably engaging the terminal array of the card.

Various IC card connectors include some form of card eject mechanism whereby an IC card is simply inserted into the connector, and the eject mechanism is used to facilitate removal of the card from the connector. For instance, the eject mechanism may include a pivotally movable eject lever and a linearly movable push member. The eject lever is engageable with the IC card to eject the card from the card connector. The push member may be an elongated push rod having an inner end engageable with the eject lever and an exposed outer end. It is known to provide a push button mounted on the outer end of the push rod. Typically, the push button is pivotally mounted on the outer end of the rod for movement between an operative position protruding colinearly from the push rod and an inoperative position protruding angularly from one side of the push rod, using friction interference between the push button and push rod during such movement. The friction interference is the sole means for holding the push button in its inoperative position. Unfortunately, such friction interference does not provide any positive latching of the push button, and continual wear causes the push button to become loose and difficult to use. The present invention is directed to solving these and other problems and to provide improvements in such IC card connectors.

SUMMARY OF THE INVENTION

An object, therefore, of the invention is to provide a new and improved IC card connector for connecting an IC card having a terminal array and ejecting the card from the connector.

In the exemplary embodiment of the invention, the IC card connector includes a support structure having receptacle means for receiving the IC card for movement to a connecting position. An eject mechanism is movably mounted on the support structure and is engageable with the IC card to eject the card from its connecting position and includes a linearly movable push member and a pivotally movable eject member. The push member is provided by an elongated push rod having an inner end engageable with the eject lever and an outer end. A push button is pivotally mounted to the outer end of the elongated push rod for movement between an operative position protruding colinearly from the outer end of the elongated push rod and an inoperative position protruding angularly from one side of the push rod. Elastic means is coupled between the push rod and the push button for biasing the push button toward its operative position. Latch means are operatively associated between the push rod and the push button for holding the push button in its inoperative position.

According to one aspect of the invention, the elastic means comprises an elongated elastic member, such as an elongated coil spring, stretched between the push rod and the push button and having opposite ends respectively fixed to the push rod and push button. The elongated elastic member or coil spring is disposed in a bore in each of the push rod and the push button. The bores are mutually colinear when the push button is in its operative position. The push button is pivotally mounted to the outer end of the push rod on an axis whereby the push button pivots to one side of the axis in its inoperative position. The bores are located at an opposite side of the axis, whereby the elongated elastic member is stretched when the push button is in its inoperative position. At least one of the push rod or push button is split in an area axially of the respective bore to allow exposure of the bore.

According to another aspect of the invention, the latch means includes a latch groove in one of the push rod or push button and a latch projection on the other of the push rod or push button. The latch groove and latch projection are sized and relatively positioned such that the latch projection snaps into latching engagement in the latch groove when the push button is moved to its inoperative position.

According to a further aspect of the invention, the push button is pivotally mounted on the outer end of the push rod such that the push button overlies an outer end of the IC card when the IC card is in its connecting position and the push button is in its inoperative position to hold the IC card in the connecting position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PRIOR ART AND THE PREFERRED EMBODIMENT

Figure 1:
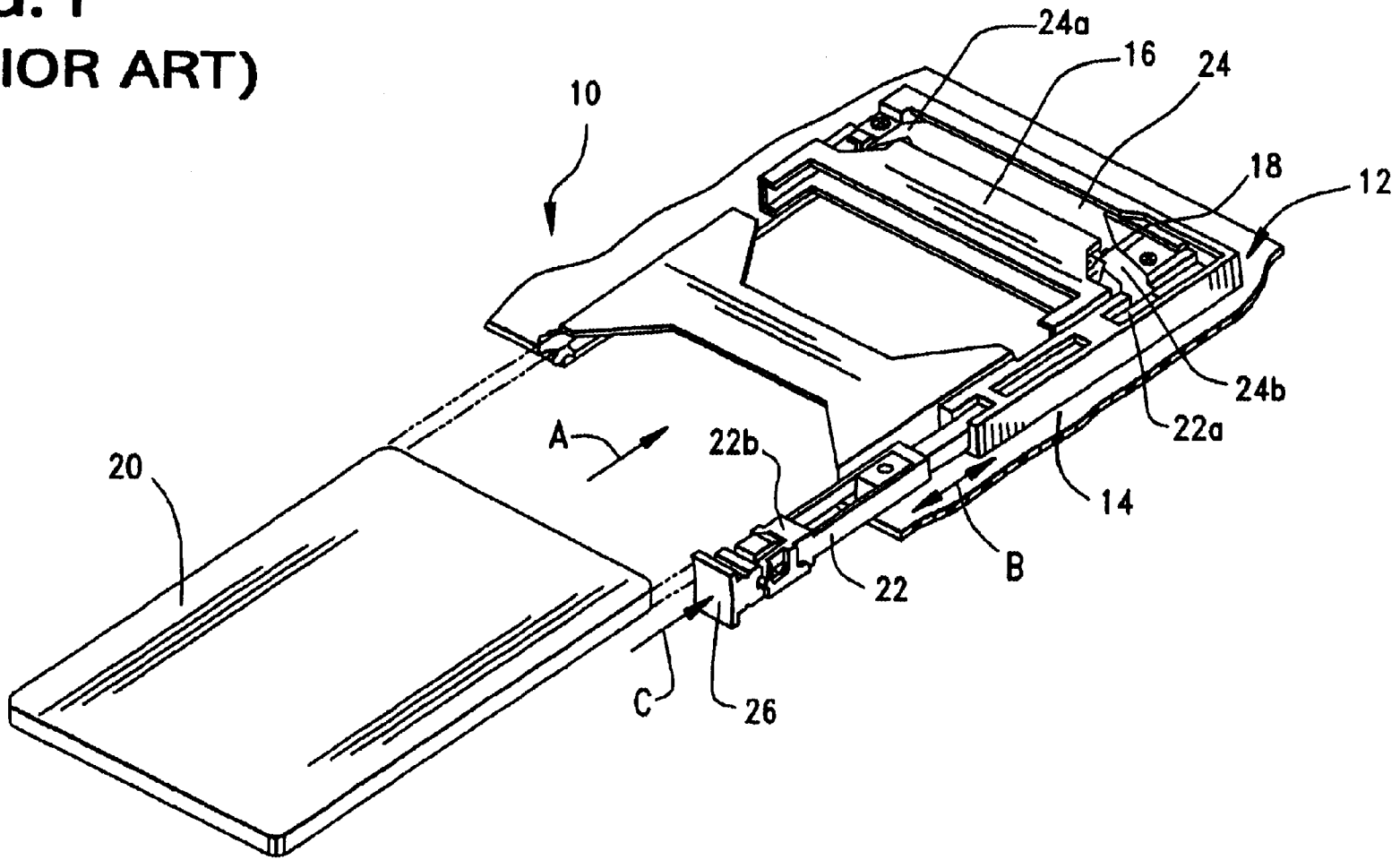
FIG. 1 (PRIOR ART)
FIG. 1 is a perspective view of an IC card connector according to the prior art.

Referring to the drawings in greater detail, and first to FIG. 1, an IC card connector, generally designated 10, is shown according to the prior art. The connector includes a support structure, generally designated 12, mounted on a printed circuit board 14. The support structure mounts a connector 16 which has a plurality of contacts 18 which yieldably engage a terminal array on the bottom, front side of an IC card 20. The contacts are electrically connected to appropriate circuit traces on the top of printed circuit board 14.

IC card 20 is inserted into support structure 12 in the direction of arrow "A" (FIG. 1) until the IC card reaches an inner connecting position whereat the terminal array on the bottom, front side of the IC card engages contacts 18 of connector 16. An eject mechanism is movably mounted on support structure 12 and is engageable with the IC card to eject the card from its connecting position. Specifically, the eject mechanism includes a linearly movable push rod 22 and a pivotally movable eject lever 24. The push rod is linearly, reciprocally movable in the direction of double-headed arrow "B". Lever 24 includes a first end 24*a* for engaging the front edge of IC card 20 to eject the card from its connecting position. A second end 24*b* of the eject lever is engageable with a distal end 22*a* of push rod 22. Therefore, when the push rod is pushed linearly inwardly in the direction of arrow "A", distal end 22*a* of the push rod pivots eject lever 24 to effectively eject IC card 20 from its connecting position.

Prior art connector 10 includes a push button 26 pivotally connected to a proximal end 22*b* of push rod 22. The push button is shown in FIG. 1 in an operative position protruding colinearly from proximal end 22*b* of push rod 22. In this position, an operator pushes on the push button in the direction of arrow "C" to linearly move the push rod and eject the IC card, as described above. The push button is pivotable to an inoperative position to one side of the push rod and is held thereat by a friction or interference fit. In essence, while the push button may be held in its operative position by various detents, movement of the push button from its operative position to its inoperative position is done through an interference fit, and the push button is held in its inoperative position using the friction of interference between the push button and the push rod. The push button is moved totally by manual manipulation. Problems continue to be encountered with such arrangements because the interference fit between the push button and the push rod becomes worn during repeated usage and, eventually, becomes loose and cannot be held in its inoperative position. The present invention is directed to solving these problems and providing improvements in such an IC card connector.

Figures 2, 3:
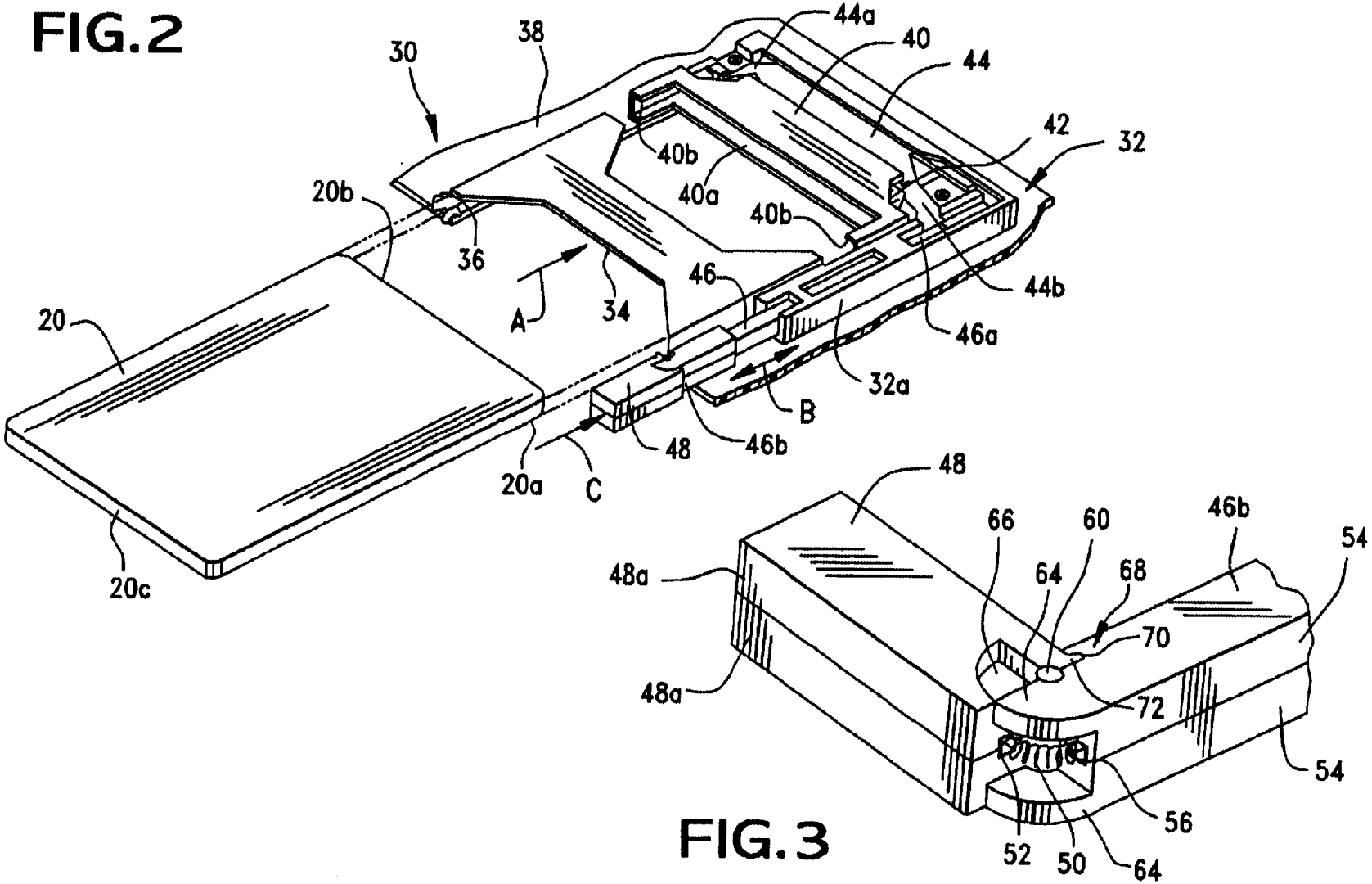
FIG. 2 is a perspective view of an IC card connector according to the invention.
FIG. 3 is an enlarged perspective view of the outer end of the push rod, with the push button in its inoperative position.

FIG. 2 shows an IC card connector, generally designated 30, according to the invention. The connector is provided for connecting an IC card 20 having a terminal array on a front, bottom side thereof, as at 20*a*. Connector 30 has means for effectively ejecting IC card 20 from the connector.

More particularly, IC card connector 30 includes a support structure, generally designated 32, which defines a receptacle 34 for receiving IC card 20 inserted into the connector in the direction of arrow "A". Side channels 36 guide the IC card into the connector. Support structure 32 is mounted on a printed circuit board 38 which includeg circuit traces on the top side thereof.

Support structure 32 mounts a connector 40 having contacts 42 which yieldably engage the terminal array at 20*a* of IC card 20. Contacts 42 are electrically coupled to the circuit traces on printed circuit board 38. A leading edge 20*b* of IC card 20 is inserted into a slot 40*a* of connector 40, as guided by a pair of side channels 40*b* of the connector which receive the side edges of the IC card.

Generally, and eject mechanism is movably mounted on support structure 32 and is engageable with leading edge 20*b* of IC card 20 to eject the card from a connecting position whereat the leading edge of the card is disposed in slot 40*a* of connector 40, with the terminal array on the IC card engaging contacts 42 of the connector. This eject mechanism includes a pivotally mounted eject lever 44 having a first end 44*a* for engaging leading edge 20*b* of IC card 20 to eject the IC card from its connecting position. The eject lever has a second end 44*b* which is engageable with a distal end 46*a* of a linearly movable, elongated push rod 46. The push rod is linearly, reciprocally mounted within an arm portion 32*a* of support structure 32, for reciprocal movement in the direction of double-headed arrow "B".

In operation, when push rod 46 is pushed inwardly in the direction of arrow "C", the interengagement of distal end 46*a* of the push rod with second end 44*b* of eject lever 44 causes the first end 44*a* of the eject lever to engage leading edge 20*b* of IC card 20 and eject the IC card from its connecting position.

Referring to FIG. 3 in connection with FIG. 2, a push button 48 is pivotally mounted, as at 50, to an outer end 46*b* of push rod 46. Push button 48 is pivotally movable on the outer end 46*b* of the push rod for movement between an operative position shown in FIG. 2 to an inoperative position shown in FIG. 3. In the operative position of push button 38 shown in FIG. 2, the push button protrudes colinearly from the outer end of the elongated push rod. In the inoperative shown in FIG. 3, the push button protrudes angularly from one side of the outer end 46*b* of the push rod.

Generally, elastic means are coupled between outer end 46*b* of push rod 46 and push button 48 for biasing the push button toward its operative position shown in FIG. 2. More particularly, the elastic means is provided by an elongated elastic member 50 which, in the preferred embodiment, comprises an elongated coil spring which is stretched between push button 48 and outer end 46*b* of the push rod. The coil spring is mounted internally of the respective structures so that the coil spring is completely hidden as seen in FIG. 2, and the coil spring is only partially exposed in the inoperative position of the push button as seen in FIG. 3.

Figure 4:
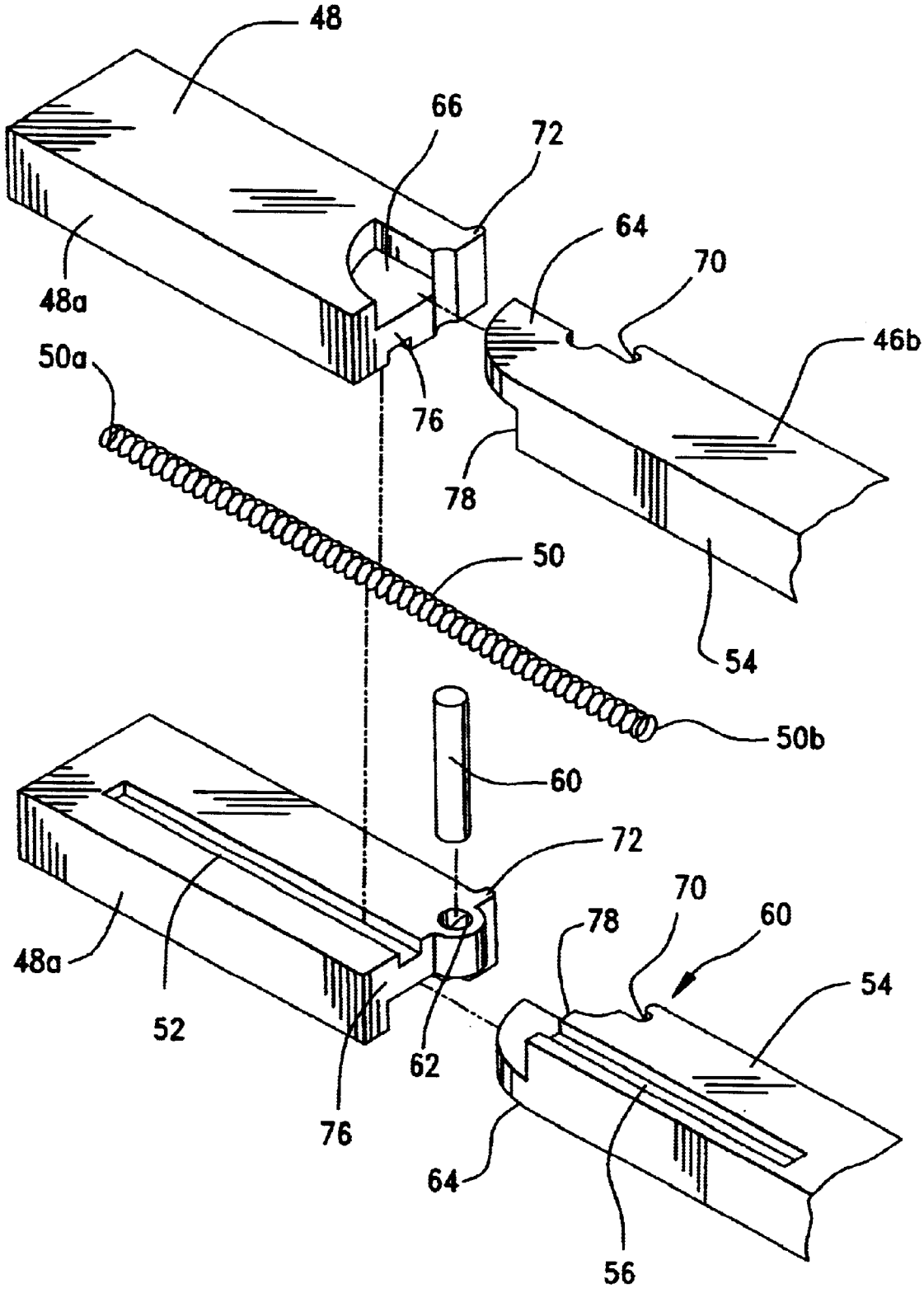
FIG. 4 is an exploded perspective view of the outer end of the push rod and the push button.
Figure 6:
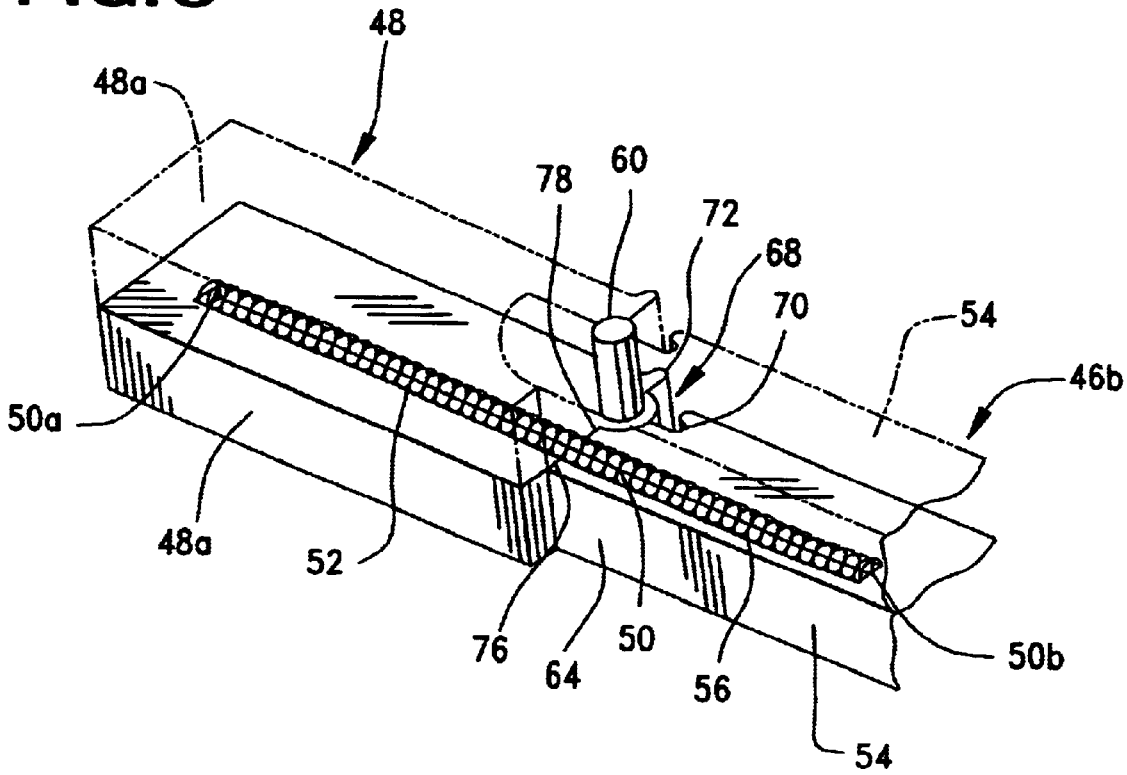
FIG. 6 is a view similar to that of FIG. 5, but with the push button in its operative position.

In order to mount the coil spring internally of the structures, push button 48 is split to define push button halves 48*a*. The inside faces of the push button halves are grooved to define a bore 52 for receiving one end 50*a* of the coil spring. The outer end 46*b* of the push rod also is split to define a pair of end halves 54. The inner faces of the end halves are grooved to define a bore 56 which receives a second end 50*b* of coil spring 50. The coil spring is assembled in grooves 52 and 56, with the opposite ends 50*a* and 50*b* of the coil spring appropriately fixed at the dead ends of the grooves, such as by an appropriate adhesive. Therefore, the remainder of the length of the coil spring is capable of expanding and contracting. When push button 48 is in its operative position protruding colinearly from outer end 46*b* of push rod 46, bores 52 and 56 are mutually colinear as seen in FIGS. 4 and 6. When the push button is moved to its inoperative position shown in FIGS. 3 and 4, coil spring 50 is stretched and, thereby, biases the push button back toward its operative position. If the push button is unlatched (as described hereinafter), coil spring 50 is effective to automatically rotate push button 48 to its operative position shown in FIGS. 2 and 6. With coil spring 50 secured within bores 52 and 56, push button halves 48*a* and end halves 54 can be appropriately adhered together to close the coil spring within the bores.

Push button 48 is pivotally mounted to outer end 46*a* of the push rod by means of a pivot shaft 60 which extends through a hole 62 in the bottom push button half 48*a* and a hole (not visible in the drawings) in bottom end half 54. The push button is guided in its pivotal or rotational movement by a pair of arcuate wings 64 projecting longitudinally from end halves 54 into a pair of arcuate recesses 66 in the top and bottom surfaces of push button halves 48*a*.

Figure 5:
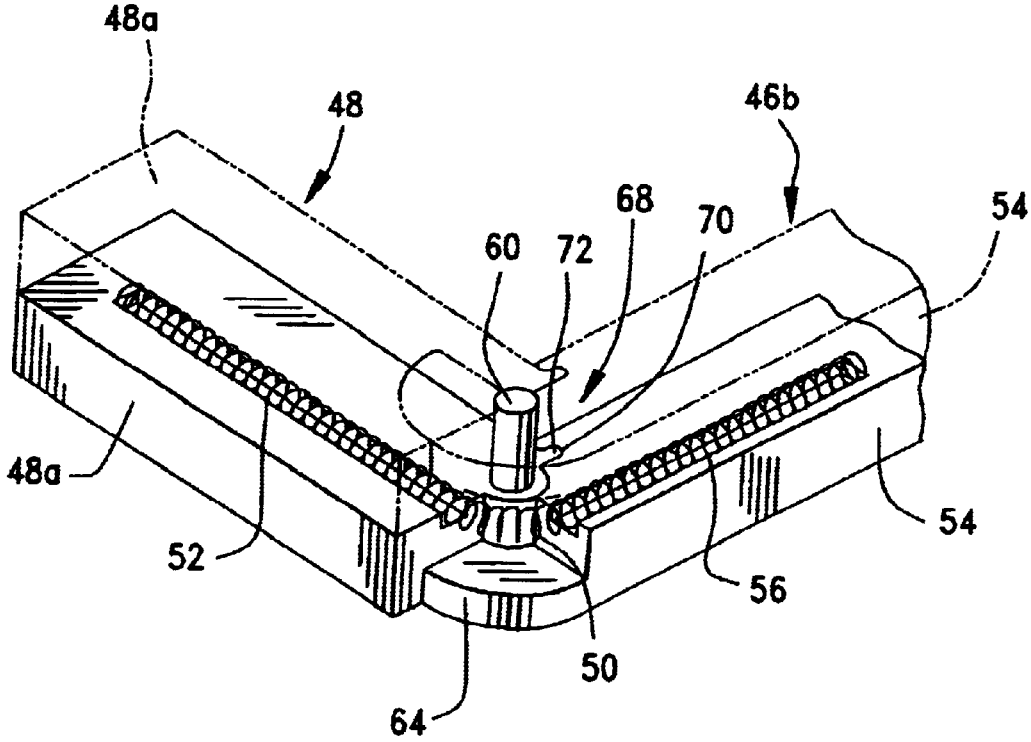
FIG. 5 is a view similar to that of FIG. 3, but with the top split portions of the outer end of the push rod and the push button shown in phantom.

Generally, latch means, generally designated 68, are operatively associated between outer end 46*b* of push rod 46 and push button 48 for holding the push button in its inoperative position shown in FIGS. 3 and 5. More particularly, latch means 68 is provided by a latch groove 70 formed in each of the end halves 54 of outer end 46*b* of the push rod. A latch projection 72 is provided on each push button half 48*a* of push button 48. Latch projections 72 are out of engagement with latch grooves 70 when push button 48 is in its operative position as seen in FIGS. 2 and 6. Latch projections 72 are in latching engagement with latch grooves 70 when the push button is in its inoperative position shown in FIGS. 3 and 5. The latch grooves and latch projections are sized and relatively positioned such that the latch projections snap into latching engagement with the latch grooves when the push button is moved to its inoperative position of FIGS. 3 and 5. Therefore, latch means 68 is effective to positively hold the latch button in its operative position, rather than relying on any type of interference or friction fit as in the prior art.

When latch button 48 is in its inoperative position as shown in FIGS. 3 and 5, the latch button will overlie a rear edge 20*c* of IC card 20 when the IC card is in its connecting position. Therefore, the push button, in its inoperative position, performs a dual function of holding the IC card in its connecting position.

Finally, and referring to FIGS. 4 and 6, push button halves 48*a* have stop surfaces 76 and end halves 54 of outer end 46*b* of the push button have stop surfaces 78 which engage stop surfaces 76 to define the operative position of push button 46 as seen in FIGS. 2, 4 and 6. Stop surfaces 76 and 78 are flat to stabilize push button 48 in its operative position protruding colinearly from outer end 46*b* of elongated push rod 46.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An IC card connector for connecting an IC card having a terminal array and ejecting the card from the connector, comprising:

a support structure having receptacle means for receiving the IC card for movement to a connecting position;

an eject mechanism movably mounted on the support structure and engageable with the IC card to eject the card from its connecting position and including a linearly movable push member and a pivotally movable eject lever, said push member comprising an elongated push rod having an inner end engageable with the eject lever and an outer end;

a push button pivotally mounted to the outer end of the elongated push rod for movement between an operative position protruding colinearly from the outer end of the push rod and an inoperative position protruding angularly from one side of the push rod;

elastic means coupled between the push rod and the push button for biasing the push button toward its operative position; and latch means operatively associated between the push rod and the push button for holding the push button in its inoperative position.

2. The IC card connector of claim 1 wherein said elastic means comprises an elongated elastic member stretched between the push rod and the push button and having opposite ends respectively fixed to the push rod and push button.

3. The IC card connector of claim 2 wherein said elongated elastic member is disposed in a bore in each of the push rod and the push button, the bores being mutually colinear when the push button is in its operative position.

4. The IC card connector of claim 3 wherein said push button is pivotally mounted to the outer end of the push rod on an axis whereby the push button pivots to one side of the axis in its inoperative position, and said bores are located at an opposite side of the axis whereby the elongated elastic member is stretched when the push button is in said inoperative position.

5. The IC card connector of claim 3 wherein at least one of said push rod or push button is split in an area axially of the respective bore to allow exposure of the bore.

6. The IC card connector of claim 2 wherein said elongated elastic member comprises a coil spring.

7. The IC card connector of claim 1 wherein said latch means comprises a latch groove in one of the push rod or push button and a latch projection on the other of the push rod or push button.

8. The IC card connector of claim 7 wherein said latch groove and latch projection are sized and relatively positioned such that the latch projection snaps into latching engagement in the latch groove when the push button is moved to its inoperative position.

9. The IC card connector of claim 1 wherein said push button is pivotally mounted on the outer end of the push rod such that the push button overlies an outer end of the IC card when the IC card is in its connecting position and the push button is in its inoperative position to hold the IC card in said connecting position.

10. An IC card connector for connecting an IC card having a terminal array and ejecting the card from the connector, comprising:

a support structure having receptacle means for receiving the IC card for movement to a connecting position;

an eject mechanism movably mounted on the support structure for ejecting the card from its connecting position and including an elongated, linearly movable push rod having an outer end;

a push button pivotally mounted to the outer end of the elongated push rod for movement between an operative position protruding colinearly from the outer end of the push rod and an inoperative position protruding angularly from one side of the push rod; and elastic means coupled between the push rod and the push button for biasing the push button toward its operative position.

11. The IC card connector of claim 10 wherein said elastic means comprises an elongated elastic member stretched between the push rod and the push button and having opposite ends respectively fixed to the push rod and push button.

12. The IC card connector of claim 11 wherein said elongated elastic member is disposed in a bore in each of the push rod and the push button, the bores being mutually colinear when the push button is in its operative position.

13. The IC card connector of claim 12 wherein said push button is pivotally mounted to the outer end of the push rod on an axis whereby the push button pivots to one side of the axis in its inoperative position, and said bores are located at an opposite side of the axis whereby the elongated elastic member is stretched when the push button is in said inoperative position.

14. The IC card connector of claim 12 wherein at least one of said push rod or push button is split in an area axially of the respective bore to allow exposure of the bore.

15. The IC card connector of claim 11 wherein said elongated elastic member comprises a coil spring.

16. An IC card connector for connecting an IC card having a terminal array and ejecting the card from the connector, comprising:

a support structure having receptacle means for receiving the IC card for movement to a connecting position;

an eject mechanism movably mounted on the support structure for ejecting the card from its connecting position and including an elongated, linearly movable push rod having an outer end;

a push button pivotally mounted to the outer end of the elongated push rod for movement between an operative position protruding colinearly from the outer end of the push rod and an inoperative position protruding angularly from one side of the push rod; and latch means operatively associated between the push rod and the push button for holding the push button in its inoperative position.

17. The IC card connector of claim 16 wherein said latch means comprises a latch groove in one of the push rod or push button and a latch projection on the other of the push rod or push button.

18. The IC card connector of claim 17 wherein said latch groove and latch projection are sized and relatively positioned such that the latch projection snaps into latching engagement in the latch groove when the push button is moved to its inoperative position.

19. The IC card connector of claim 16 wherein said push button is pivotally mounted on the outer end of the push rod such that the push button overlies an outer end of the IC card when the IC card is in its connecting position and the push button is in its inoperative position to hold the IC card in said connecting position.

* * * * *